US006899163B2

(12) United States Patent
Finch et al.

(10) Patent No.: US 6,899,163 B2
(45) Date of Patent: May 31, 2005

(54) PLATE HEAT EXCHANGER AND METHOD FOR USING THE SAME

(75) Inventors: Derek I Finch, Goldsboro, NC (US); Ranjieve Ariarasah, Raleigh, NC (US)

(73) Assignee: APV North America, Inc., Schiller Park, IL (US)

( * ) Notice: Subject to any disclaimer, the term of this patent is extended or adjusted under 35 U.S.C. 154(b) by 24 days.

(21) Appl. No.: 10/395,491

(22) Filed: Mar. 24, 2003

(65) Prior Publication Data

US 2004/0188060 A1 Sep. 30, 2004

(51) Int. Cl.[7] ..... F28F 9/00

(52) U.S. Cl. ..... 165/67; 165/76; 165/78; 165/166

(58) Field of Search ..... 165/166, 170, 165/146, 165, 167, 76, 78

(56) References Cited

U.S. PATENT DOCUMENTS

| | | | | | |
|---|---|---|---|---|---|
| 1,754,857 | A | | 4/1930 | Harrison | |
| 2,300,663 | A | | 11/1942 | Fette | |
| 2,610,834 | A | * | 9/1952 | Dalzell | 165/78 |
| 2,621,028 | A | | 12/1952 | Newhall | |
| 2,639,126 | A | | 5/1953 | Newhall | |
| 3,448,796 | A | * | 6/1969 | Usher | 165/78 |
| 4,090,556 | A | * | 5/1978 | Almqvist | 165/78 |
| 4,398,591 | A | * | 8/1983 | Bond | 165/78 |
| 4,499,942 | A | * | 2/1985 | Allison | 165/78 |
| 4,640,740 | A | * | 2/1987 | Moore et al. | 159/13.1 |
| 4,813,478 | A | * | 3/1989 | Jonsson et al. | 165/78 |
| 5,056,590 | A | * | 10/1991 | Bohn | 165/78 |
| 5,462,112 | A | * | 10/1995 | Johansson | 165/167 |
| 5,740,859 | A | * | 4/1998 | Finch | 165/67 |

FOREIGN PATENT DOCUMENTS

| | | | |
|---|---|---|---|
| DE | 842357 | 6/1952 | |
| GB | 2049144 a | * 12/1979 | 165/166 |
| SU | 1449-309 A | 1/1989 | |
| WO | WO99/23434 A1 | 5/1999 | |

OTHER PUBLICATIONS

APV, APV 1935 Heat Exchanger Type HH With Hydraulic Operating Gear, Instructions for Erection, Operating and Dismantling, 1936, 16pp.

* cited by examiner

*Primary Examiner*—Terrell Mckinnon
(74) *Attorney, Agent, or Firm*—Myers Bigel Sibley & Sajovec, P.A.

(57) ABSTRACT

A plate heat exchanger includes first and second plates, a package of heat transfer plates arranged between the first and second plates, and a closure system. The closure system includes a plurality of tie bar assemblies. Each tie bar assembly includes a tie bar extending between the first and second plates, and a threaded member threadedly engaging the tie bar. The closure system and the first and second plates are relatively arranged and configured such that relative rotation between the tie bar and the threaded member of each tie bar assembly is operative to move the first plate towards and away from the second plate to close and open, respectively, the plate heat exchanger. The plate heat exchanger is arranged and configured such that the heat transfer plates can be removed from the plate heat exchanger without relocating any of the tie bars.

50 Claims, 10 Drawing Sheets

PLATE HEAT EXCHANGER AND METHOD FOR USING THE SAME

FIELD OF THE INVENTION

The present invention relates to a plate heat exchanger of the kind comprising a package of heat transfer plates clamped together between two end plates and, more particularly, to an improved system for releasably clamping the package of heat transfer plates to permit inspection, cleaning, repair and/or removal.

BACKGROUND OF THE INVENTION

In certain industries, heat exchangers are required to be opened weekly or daily to inspect the heat transfer plates. This process can require the removal of one or more plates for closer inspection or cleaning.

Traditionally, one of the end plates, commonly referred to as the head, is fixed and the other end plate, commonly referred to as the follower, is moveable towards the head to close the heat exchanger and is movable away from the head to open the heat exchanger.

Heat exchangers of this type are well known and typically include at least two spindles carrying nuts that can be rotated to urge the follower towards the head. Manual rotation of the nuts can result in uneven closure forces being applied to the package of heat transfer plates by the follower. This can lead to incomplete sealing between the heat transfer plates giving rise to leaks. This in turn may lead to contamination of a product, for example milk, by coolant.

APV Products previously developed a heat exchanger having a powered closure system first available in the USA in 1987 and known as a CR-5 plate heat exchanger. This heat exchanger is shown in FIG. 1 and includes a support frame 1 for a plate pack 2 located between a fixed head 3 at one end of the frame 1 and a movable follower 4. As shown, the plate pack 2 includes groups of heat transfer plates 5, 6 separated by connector grids 7 and divider plates 8. The plate pack 2 is located and supported between horizontal upper and lower beams 9, 10 extending between the head 3 and a drive housing 11 at the other end of the frame 1.

The follower 4 is arranged between the beams 9, 10 and is movable towards the head 3 by a pair of jack screws 12, 13 extending between the follower 4 and the drive housing 11. The jack screws 12, 13 are operable synchronously by a drive mechanism (not shown) located within the drive housing 11. The drive mechanism includes an electric motor, hydraulic pump and hydraulic motor to drive synchronously two coaxial drive sprockets each connected to a driven sprocket by a separate flexible drive chain. The driven sprockets are coupled to two jack nuts that rotate and thereby move the jack screws 12, 13 and the output from the motor is reversible for rotating the driven sprockets in either one of two opposed directions.

In this way, rotation of the sprockets in one direction simultaneously and synchronously extends the jack screws 12, 13 and rotation of the sprockets in the opposite direction simultaneously and synchronously retracts the jack screws 12, 13. As a result, extending the jack screws 12, 13 pushes the follower 4 towards the head 3 to clamp the plate pack 2 between the head 3 and follower 4. Retracting the jack screws 12, 13 permits the follower 4 to move away from the head 3 to release the plate pack 2 for inspection.

Although the powered system avoids some problems associated with manual operation of the closure system, the jack screws 12, 13 are loaded in compression when the heat exchanger is closed and there is an inherent limitation in the length of the jack screws 12, 13 that can be employed. Thus, only a certain number of plates can be installed without increasing the diameter of the jack screws 12, 13 and plate quantity requirements in certain industries already exceed the limitations of this design. In addition, the drive housing 11 has to be sized to accept the full compressive and hydraulic loads associated with closing and pressurizing the heat exchanger.

FIGS. 2 and 3 show heat exchangers with powered closure systems as disclosed in U.S. Pat. No. 5,462,112 to Johansson, issued Oct. 31, 1995.

The closure system shown in FIG. 2 is similar to that employed in the CR-5 plate heat exchanger described above with reference to FIG. 1 and has four bolts 20–23 extending between the follower 24 and a frame plate 25 supporting a motor 26. The bolts 20–23 engage at one end nuts 27, 28 (two only shown) fixed to the follower 24 and at the other end nuts 29–32 rotatably supported on the frame plate 25. The nuts 29–32 are synchronously rotatable by the motor 26 via a flexible endless drive belt 33. In this way, the bolts 20–23 are axially extendable to push the follower 24 towards fixed head 34 to clamp the plate pack 35 by rotation of the nuts 29–32 in one direction. Rotation of the nuts 29–32 in the opposite direction moves the follower 24 away from the head 34 to release the plate pack 35. With this arrangement, the bolts 20–23 are loaded in compression when the heat exchanger is closed and this system therefore suffers from the same structural limitations and disadvantages as the system shown in FIG. 1.

The closure system shown in FIG. 3 has four bolts 50, 51 (two only shown) that are loaded in tension when the heat exchanger is closed. Two bolts 50, 51 extend between the fixed head 52 and the movable follower 53 on one side of the plate pack 54 and the other two bolts (not shown) extend between the fixed head 52 and follower 53 on the other side of the plate pack 53. The drive mechanism is mounted on the fixed head 52 and includes a motor 55 for simultaneously and synchronously rotating all the bolts 50, 51 (as well as the two bolts not shown) via an endless flexible drive belt (not shown). Each bolt 50, 51 engages a nut 56, 57 (two only shown) that is prevented from rotating and separating axially from the follower 53.

In this way, rotation of the bolts 50, 51 causes the nuts 56, 57 to move axially along the bolts 50, 51 carrying with them the follower 53. As a result, the follower 53 is pulled towards the fixed head 52 by rotation of the bolts 50, 51 in one direction to close the heat exchanger. Rotation of the bolts 50, 51 in the opposite direction pushes the follower 53 away from the fixed head 52 to open the heat exchanger.

As can be seen, with this arrangement, access to the plate pack 54 is restricted by the bolts 50, 51 (and the two not shown) on each side and by the upper and lower beams 58, 59 connecting the fixed head 52 to the plate 60 at the other end of the support frame. Accordingly, if it is desired to remove one or more plates 61 from the heat exchanger, at least two of the bolts 50, 51 on one side of the plate pack 54 must first be removed to provide access to withdraw the plates 61 sideways. On heat exchangers with large plate packs 54 and therefore longer and heavier bolts 50, 51, such a task can exceed the strength of one person and thereby necessitate the use of further personnel or even mechanical handling equipment.

Furthermore, before removal of the bolts 50, 51, the drive belt first has to be completely removed from the driving mechanism. Because the drive belt is under tension, the tensioner mechanism must be relaxed further extending the time and effort required to access the plate pack 54. Such removal of the drive belt is highly unconventional for normal machine operation and imposes a complexity that goes beyond the expected expertise of general heat exchanger operators.

Moreover, replacement of the bolts 50, 51 and the drive belt may require the exact relative alignment of each driven coupling to the bolts 50, 51 to ensure parallel movement of the follower 53 towards and away from the fixed head 52.

SUMMARY OF THE INVENTION

According to embodiments of the present invention, a plate heat exchanger includes first and second plates, a package of heat transfer plates arranged between the first and second plates, and a closure system. The closure system includes a plurality of tie bar assemblies. Each tie bar assembly includes a tie bar extending between the first and second plates, and a threaded member threadedly engaging the tie bar. The closure system and the first and second plates are relatively arranged and configured such that relative rotation between the tie bar and the threaded member of each tie bar assembly is operative to move the first plate towards and away from the second plate to close and open, respectively, the plate heat exchanger. The plate heat exchanger is arranged and configured such that the heat transfer plates can be removed from the plate heat exchanger without relocating any of the tie bars.

According to further embodiments of the present invention, a method for cleaning, repairing and/or modifying a plate heat exchanger includes providing a plate heat exchanger including first and second plates, a package of heat transfer plates arranged between the first and second plates, and a closure system. The closure system includes a plurality of tie bar assemblies. Each tie bar assembly includes a tie bar extending between the first and second plates, and a threaded member threadedly engaging the tie bar. The closure system and the first and second plates are relatively arranged and configured such that relative rotation between the tie bar and the threaded member of each tie bar assembly is operative to move the first plate towards and away from the second plate to close and open, respectively, the plate heat exchanger. The first plate is moved towards the second plate by rotating the tie bar assemblies to close the plate heat exchanger. The first plate is moved away from the second plate by rotating the tie bar assemblies to open the plate heat exchanger. Thereafter, at least one of the heat transfer plates is removed from the opened plate heat exchanger without removing any of the tie bars from the plate heat exchanger.

According to yet further embodiments of the present invention, a plate heat exchanger includes first and second plates, a package of heat transfer plates arranged between the first and second plates, and a closure system. The closure system includes at least two tie bars extending between the first and second plates and adapted to maintain a compressive load applied to the package of heat transfer plates by the first and second plates, and a motor operable to control the compressive load. The plate heat exchanger is arranged and configured such that the heat transfer plates can be removed from the plate heat exchanger without relocating any of the tie bars.

According to further embodiments of the present invention, a plate heat exchanger includes first and second plates, a package of heat transfer plates arranged between the first and second plates, and a closure system. The closure system includes a plurality of tie bar assemblies. Each tie bar assembly includes a tie bar extending between the first and second plates, and a threaded member threadedly engaging the tie bar. The closure system and the first and second plates are relatively arranged and configured such that relative rotation between the tie bar and the threaded member of each tie bar assembly is operative to move the first plate towards and/or away from the second plate to close and/or open, respectively, the plate heat exchanger. A plurality of flexible, endless drive members are each connected to a respective one of the tie bars and/or threaded members such that each of the drive members rotates only one of the tie bars and threaded members. A motor is operative to synchronously drive the drive members to rotate the tie bars and/or threaded members.

According to still further embodiments of the present invention, a plate heat exchanger includes a frame and first and second plates mounted on the frame. A package of heat transfer plates is arranged between the first and second plates. The plate heat exchanger further includes a closure system including a plurality of tie bars extending between the first and second plates and arranged for movement of the first plate towards or away from the second plate. The plate heat exchanger is arranged and configured such that the heat transfer plates can be removed from the plate heat exchanger without relocating any of the tie bars and without relocating, partially or fully, any components of the frame.

Objects of the present invention will be appreciated by those of ordinary skill in the art from a reading of the figures and the detailed description of the preferred embodiments which follow, such description being merely illustrative of the present invention.

DETAILED DESCRIPTION OF THE EMBODIMENTS OF THE PRESENT INVENTION

Figure 1:
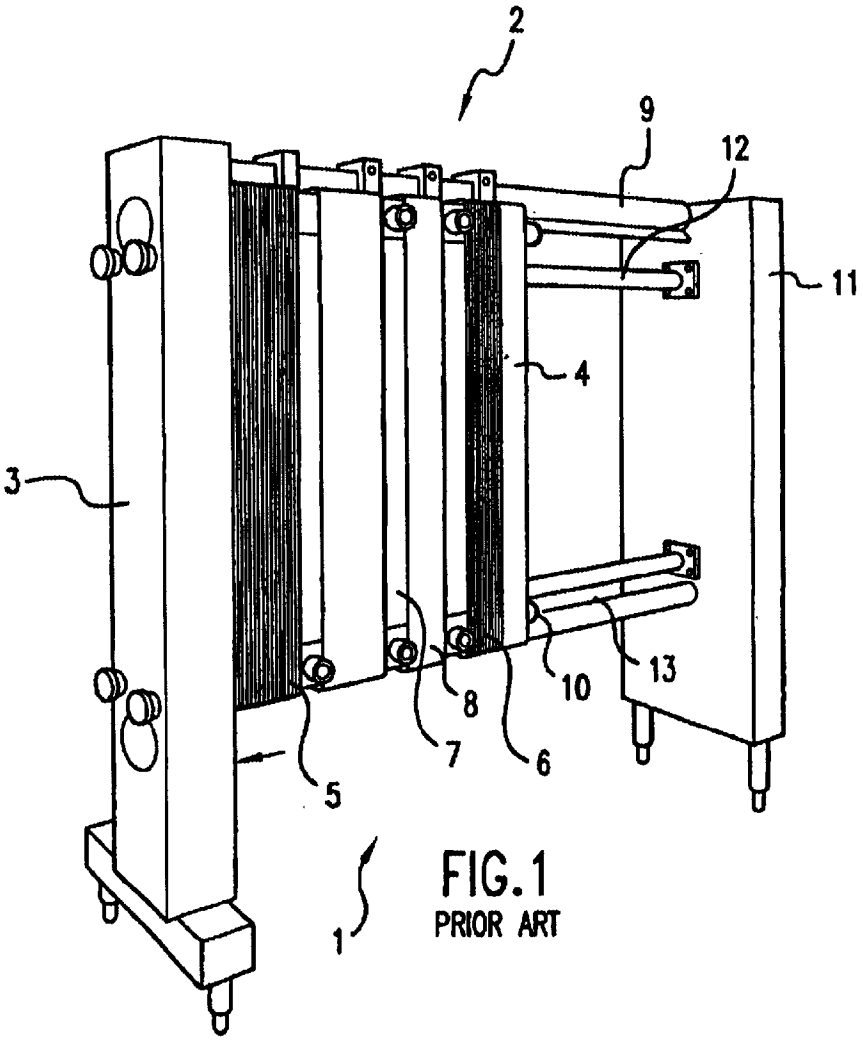
FIG. 1 PRIOR ART
FIG. 1 is a perspective view of a prior art heat exchanger with a powered closure system.
Figure 2:
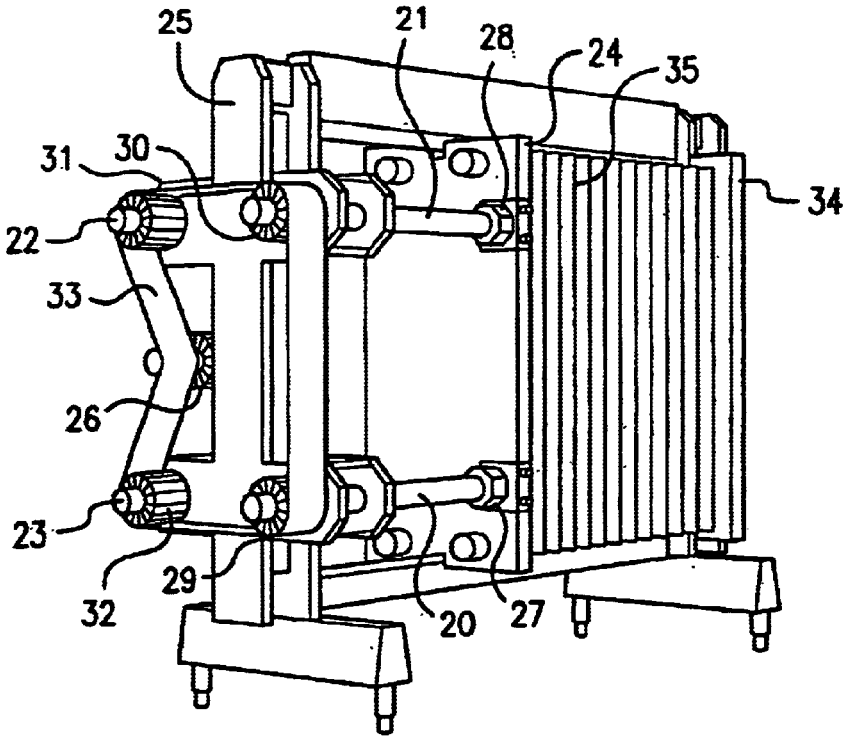
FIG.2 PRIOR ART
FIG. 2 is a perspective view of another prior art heat exchanger with a powered closure system.
Figure 3:
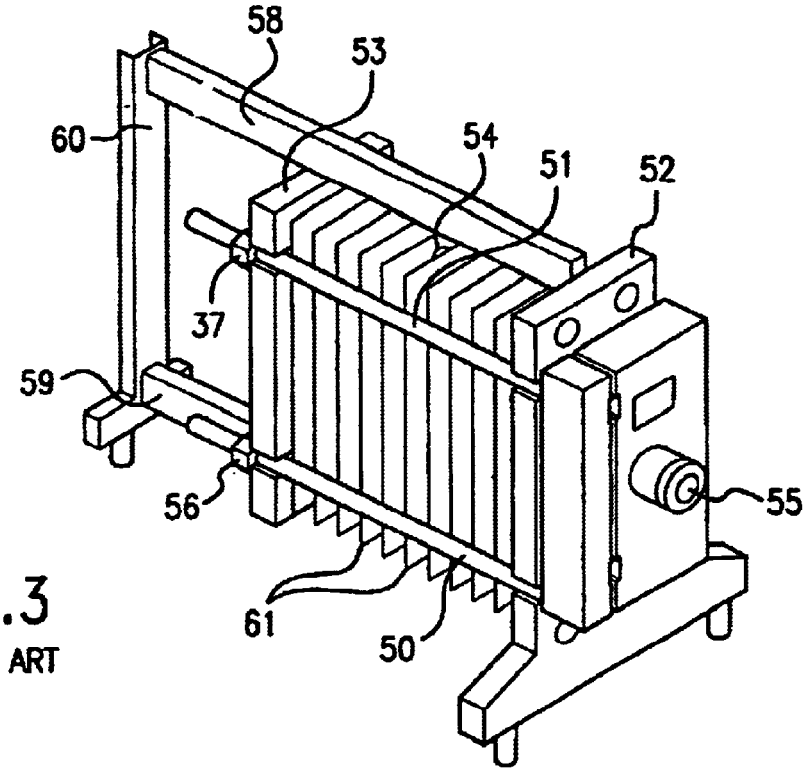
FIG.3 PRIOR ART
FIG. 3 is a perspective view of yet another prior art heat exchanger with a powered closure system.
Figure 4:
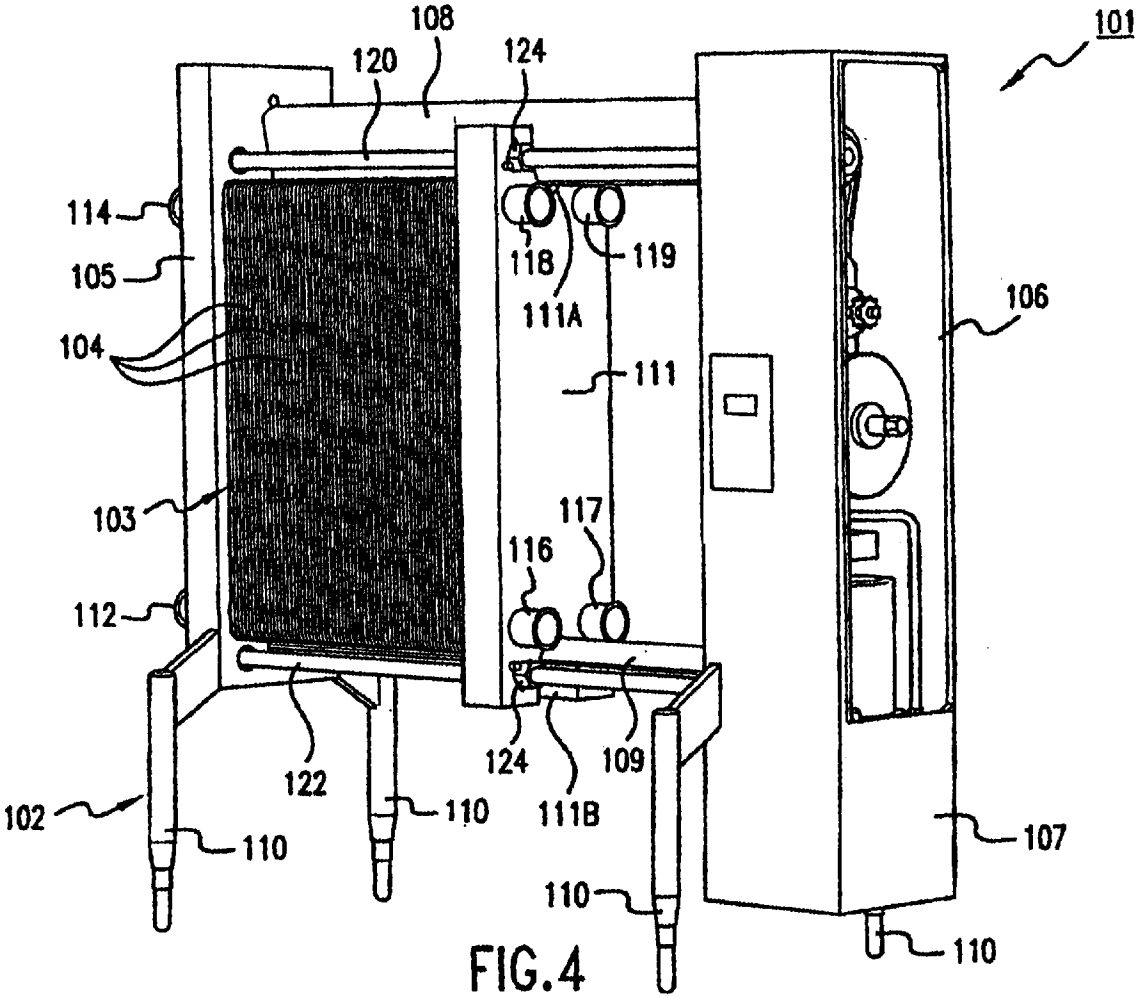
FIG. 4 is a perspective view of a heat exchanger according to embodiments of the present invention in a closed position with a door thereof removed.

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the relative sizes of regions may be exaggerated for clarity. It will be understood that when an element such as a layer, region or substrate is referred to as being "on" another element, it can be directly on the other element or intervening elements may also be present. In contrast, when an element is referred to as being "directly on" another element, there are no intervening elements present.

Referring to FIGS. 4 to 11 of the accompanying drawings, there is shown a heat exchanger 101 comprising a support frame 102 for a pack 103 of heat transfer plates 104 of metal or other heat conductive material compatible with the fluid(s) to be passed through the heat exchanger 101.

The support frame 102 comprises a head or frame plate 105 at one end connected to an enclosure 107 at the other end containing a driving mechanism 106 (FIGS. 4 and 6–8) by spaced parallel upper and lower beams 108, 109. The beams 108, 109 are preferably rigidly affixed to the plate 105 and the enclosure 107. The frame plate 105 and housing 107 are provided with ground engaging feet 110 laterally offset on opposite sides of the frame 102 for added stability.

The beams 108, 109 locate and support the pack 103 of heat transfer plates 104 and a follower or pressure plate 111 that is moveable relative to the frame plate 105 to open and close the heat exchanger 101 as described later herein. Upper and lower slots 111A and 111B receive the upper and lower beams 108 and 109, respectively. The frame plate 105 and pressure plate 111 are commonly referred to as the head and the follower, respectively, and these terms are used in the following description for convenience.

Figure 10:
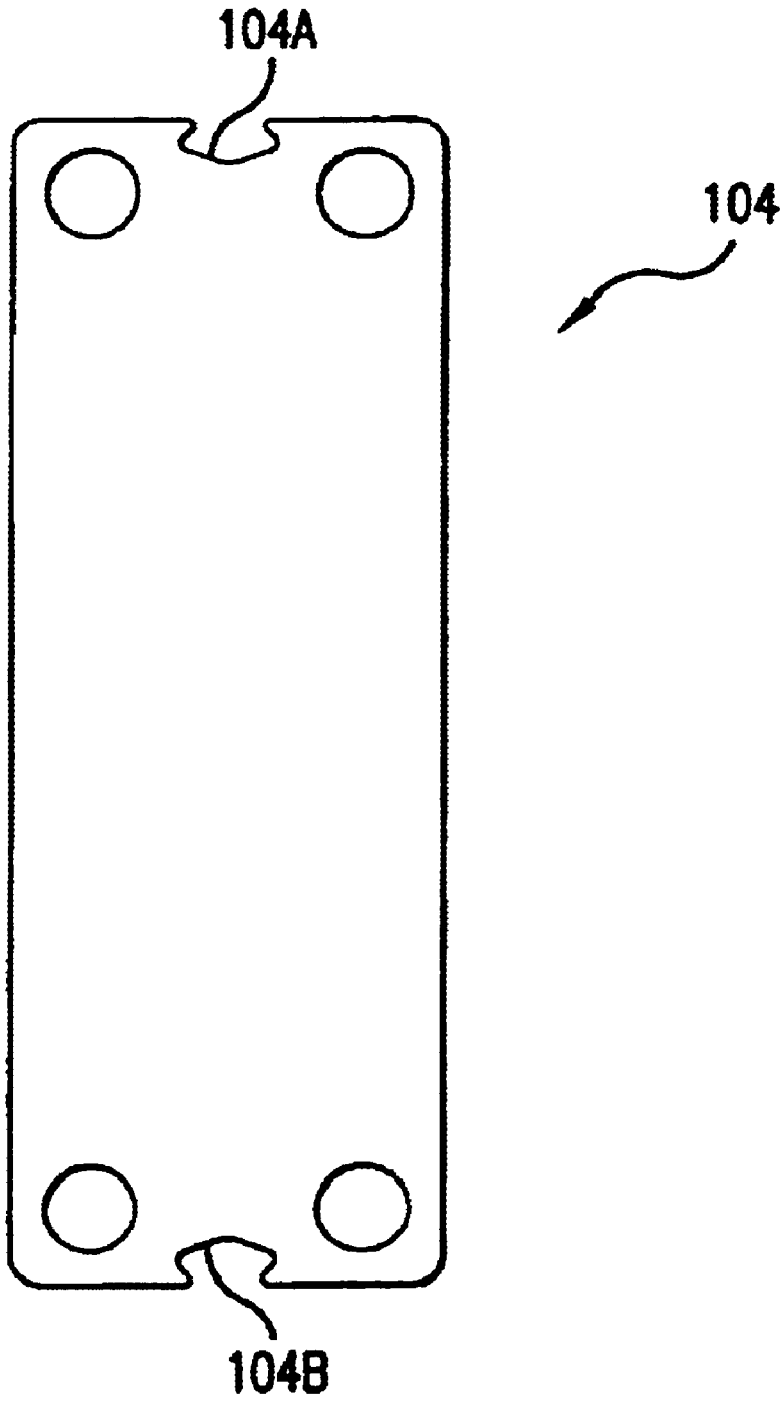
FIG. 10 is a front view of a heat transfer plate of the heat exchanger of FIG. 4.

The plate pack 103 is clamped together between the head 105 and the follower 111 when the heat exchanger 101 is closed and sealing gaskets (not shown) between the plates 104 form separate passageways for fluids to flow through the heat exchanger 101. The passageways communicate with combinations of four ports 112, 113, 114, 115 (FIGS. 4 and 5) in the head 105 and combinations of four ports 116, 117, 118, 119 (FIGS. 4 and 5) in the follower 111 for fluid to flow into and out of the heat exchanger 101. The heat transfer plates may include one or a pair of end plates that do not include fluid on both sides (and, thus, are not technically considered heat transfer plates) but are similarly mounted in the frame 102 and thus from a part of the pack 103. With reference to FIGS. 6 and 10, each plate 104 has upper and lower slots 104A, 104B that slidably receive the upper and lower beams 108 and 109, respectively. The upper beam 108 has opposed lengthwise extending flanges 108A (see FIGS. 5 and 6), and the upper slots 104A may be configured such that the plates 104 hang on the flanges 108A.

The support frame 102 further includes four tie bars 120, 121, 122, 123 (collectively referred to herein as "tie bars 120–123") extending between the head 105 and the enclosure 107. One pair of tie bars 120, 121 are located on opposite sides of the upper beam 108 and may be spaced above the plate pack 103. The other pair of tie bars 122, 123 are located on opposite sides of the lower beam 109 and may be spaced below the plate pack 103. The tie bars 120–123 are located outside of the outer peripheries of the heat transfer plates 104. Preferably, the tie bars 120–123 are positioned adjacent to the shorter edges of the heat transfer plates 104. According to some embodiments, the tie bars 120–123 are preferably all located above or below the heat transfer plate. Moreover, according to some embodiments, some of the tie bars are located above the heat transfer plates while the remainder of the tie bars are located below the heat transfer plates.

The tie bars 120–123 bear directly or indirectly at one end against the head 105 and are rotatable relative to the head 105 via friction reducing bearings (not shown). The tie bars 120–123 are coupled at their opposite ends to the driving mechanism 106 within the enclosure 107 for rotating the tie bars 120–123 as described in more detail later herein.

Each tie bar 120–123 is externally threaded and extends through the follower 111 and threadedly and loosely engages a nut 124 that bears directly or indirectly against the follower 111 on the side remote from the head 105. Each tie bar 120–123 and its associated nut 124 collectively form a tie bar assembly. Each nut 124 is captured to prevent rotation and axial separation relative to the follower 111. In this way, the nuts 124 move along the tie bars 120–123 in response to rotation of the tie bars 120–123 and the follower 111 moves with the nuts 124. As a result, rotation of the tie bars 120–123 in one direction causes the follower 111 to move towards the head 105 to close the heat exchanger 101 and rotation in the opposite direction causes the follower 111 to move away from the head 105 to open the heat exchanger 101. Alternatively, the nuts 124 may be arranged to allow rotation relative to the follower 111 so that rotation of the nuts 124 relative to the follower 111 and the associated tie bar moves the follower 111 toward and away from the head 105.

Figure 5:
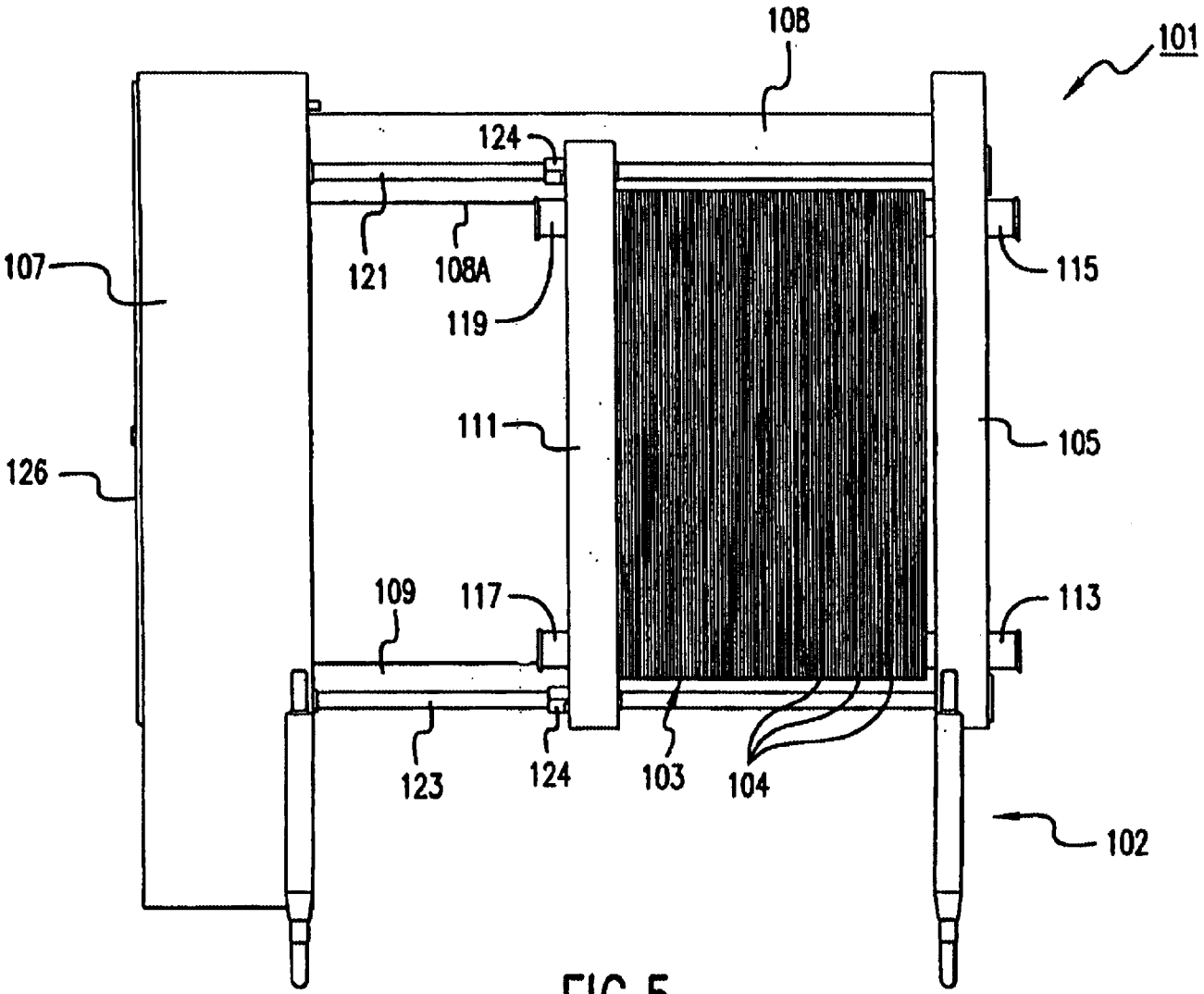
FIG. 5 is a side view of the heat exchanger of FIG. 4 in the closed position.
Figure 6:
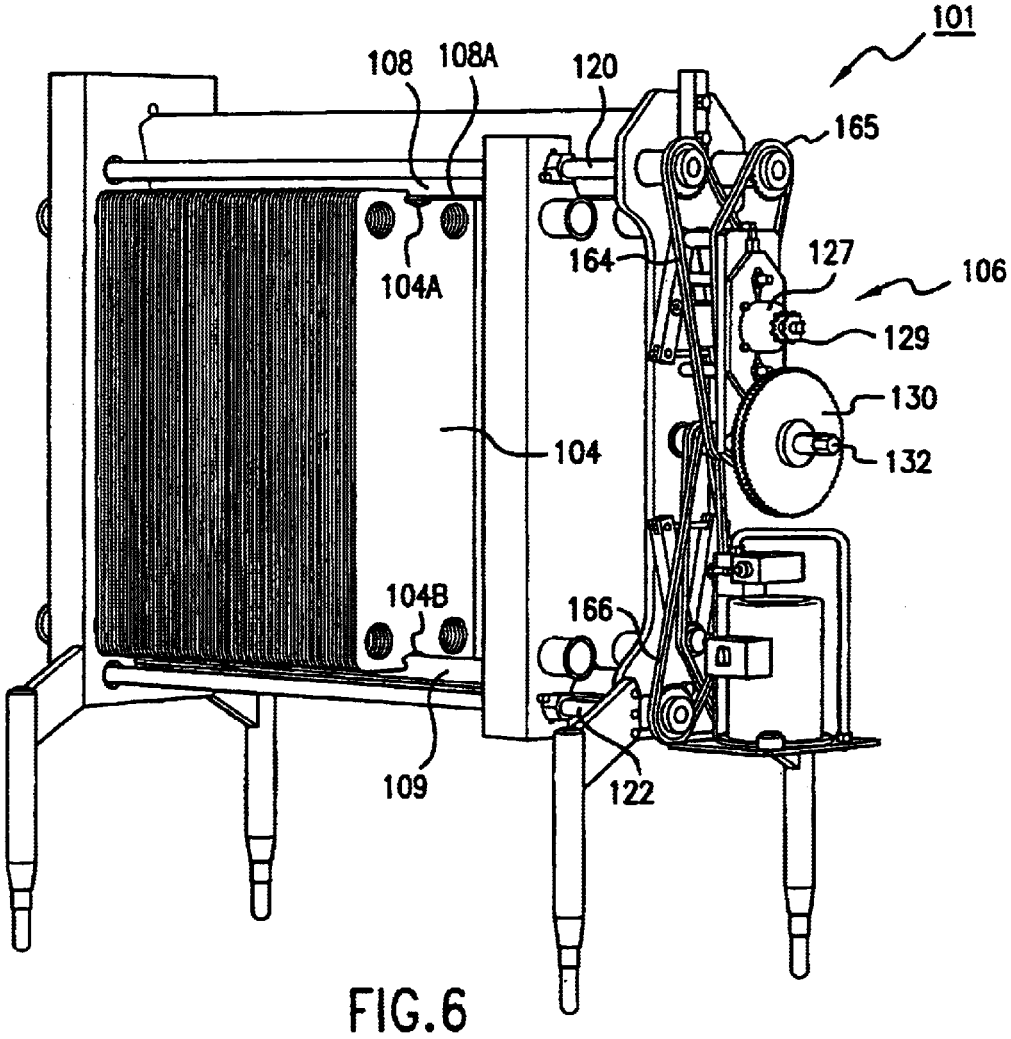
FIG. 6 is a perspective view of the heat exchanger of FIG. 4 in an open position and with an enclosure thereof removed to show a drive mechanism.
Figure 7:
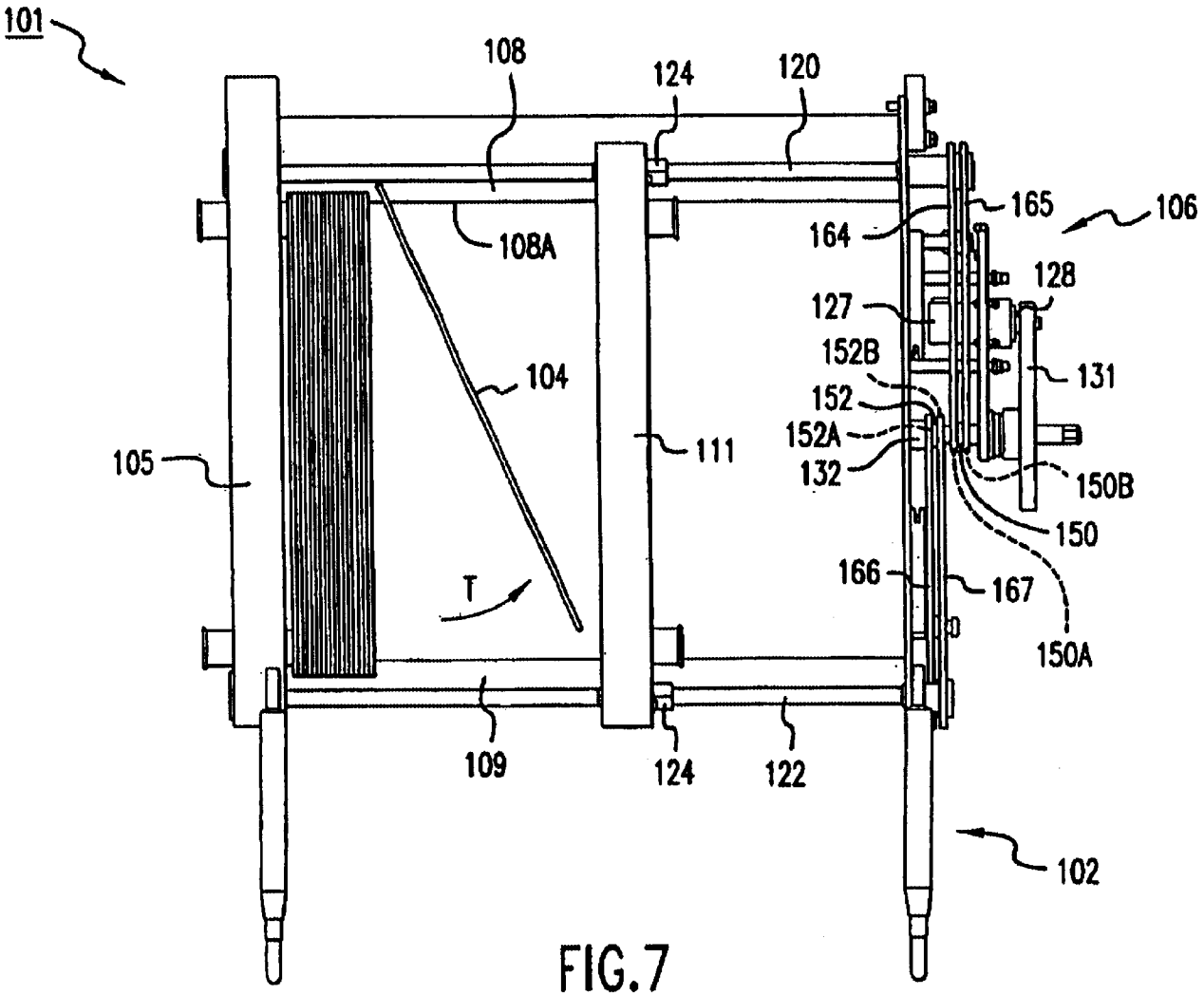
FIG. 7 is a side view of the heat exchanger of FIG. 4 in the open position with the drive enclosure and portions of the drive mechanism removed.
Figure 8:
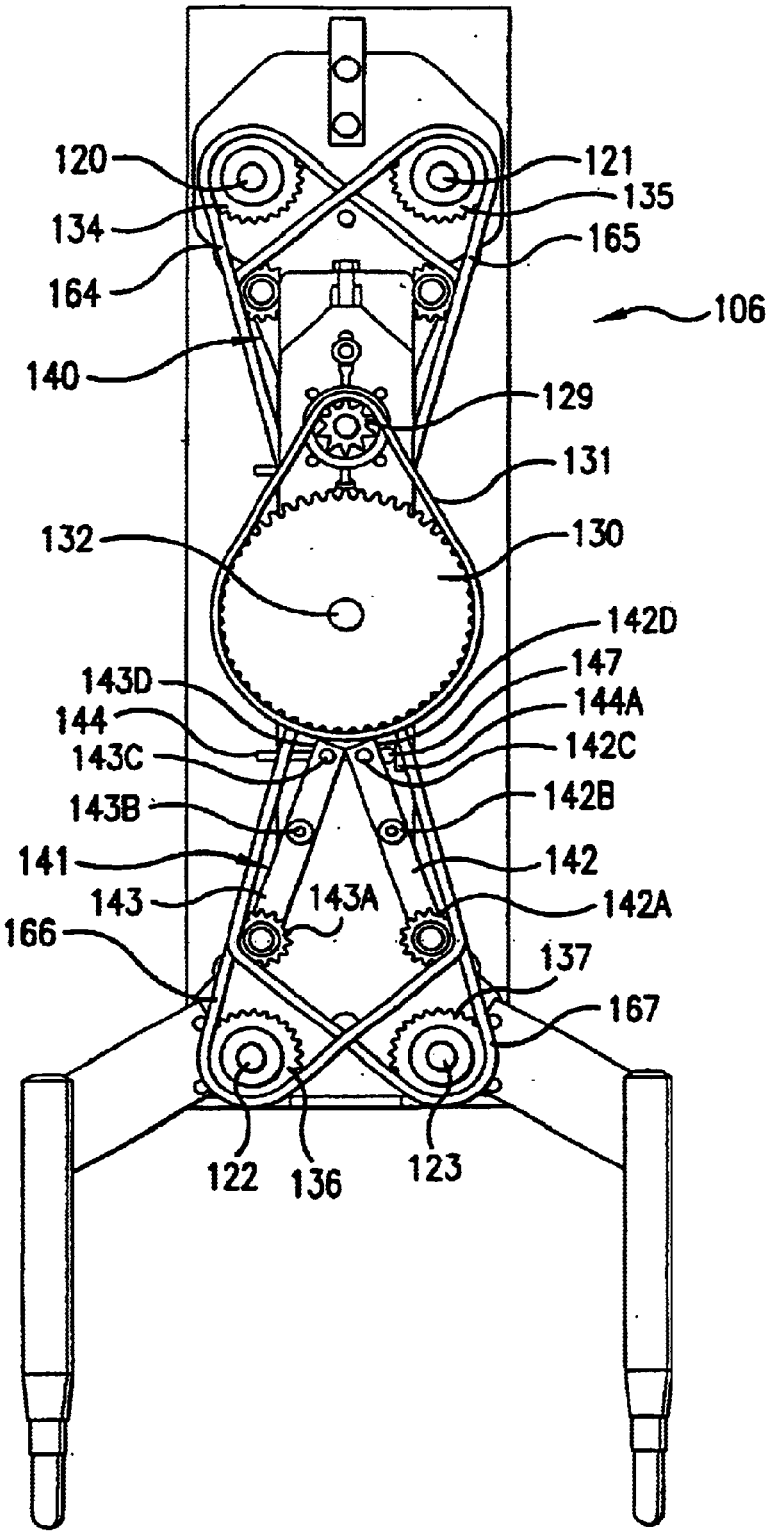
FIG. 8 is an end view of the heat exchanger as shown in FIG. 7.

Referring now to FIGS. 6–8, the drive mechanism 106 for rotating the tie bars 120–123 is located in the enclosure 107 and is accessible for observation or servicing via a door 126 (FIG. 5). For clarity, the door 126 has been omitted from each of the other figures.

According to some embodiments, the tie bars 120–123 preferably may be rotated separately, for example, during manufacture to initially align the follower 111 with the head 105. In use, however, all the tie bars 120–123 are preferably synchronously rotated at the same time to open and close the heat exchanger 101. In this way, the movable plate 111 is maintained parallel to the fixed plate 105, ensuring uniform loading of the plate pack 104 that eliminates or reduces the risk of leaks occurring when the heat exchanger 101 is closed. Synchronous rotation may be effected by a drive mechanism including at least one endless flexible drive member such as a chain or toothed belt in driving engagement with the tie bars. According to certain embodiments, multiple endless drive members may be employed. According to certain preferred embodiments as described below, a different endless drive member is used for each tie bar with each drive member being arranged to be driven synchronously. Compared to a single drive member that must be strong enough to rotate the sum of all the tie bars, multiple drive members are only required to provide a proportionate fraction of the strength. A corresponding size and therefore cost reduction may be achieved from the use of lighter drive members and associated sprockets or gears of the drive mechanism.

The drive mechanism 106 includes a drive motor 127. The drive motor 127 may be any suitable type motor such as a hydraulic, pneumatic or electric motor or a combination thereof. The motor 127 has a drive shaft 128 carrying a small diameter sprocket 129 connected to a large diameter sprocket 130 via an endless flexible drive chain 131. The sprocket 130 is mounted fast on a rotatable shaft 132 that also carries two further coaxial sprockets 150, 152 of smaller diameter. The sprocket 150 includes two sets of teeth 150A, 150B. Likewise, the sprocket 152 includes two sets of teeth 152A, 152B. Alternatively (not shown), the two sprockets 150, 152 may be replaced with four individual sprockets.

Each of the tie bars 120, 121, 122, 123 has a sprocket 134, 135, 136, 137, respectively, coupled fast to an end thereof. A flexible drive chain 164 extends about the set of teeth 150A and the sprocket 134. A flexible drive chain 165 extends about the set of teeth 150B and the sprocket 135. A flexible drive chain 166 extends about the set of teeth 152A and the sprocket 136. A flexible drive chain 167 extends about the set of teeth 152B and the sprocket 137. Thus, the tie bars 120, 121, 122, 123 are each driven by a separate one of the drive chains 164, 165, 166, 167. That is, each of the drive chains 164, 165, 166, 167 drives only one of the tie bars 120, 121, 122, 123.

An upper chain tensioner 140 maintains the tensions in the chains 164, 165 and a lower chain tensioner 141 maintains the tensions in the chains 166, 167. The upper chain tensioner 140 is substantially identical to the lower tensioner 141. Therefore, only the tensioner 141 will be described in detail, it being appreciated that such description likewise applies to the tensioner 140.

The tensioner 141 includes arms 142, 143. The arm 142 has an inner end 142D and a rotatable roller, preferably a sprocket, 142A mounted on its opposing, outer end. The arm 143 has an inner end 143D and a rotatable roller, preferably a sprocket, 143A on its opposing outer end. The sprockets 142A, 143A engage the drive chains 167, 166, respectively.

The arms 142, 143 are joined to the frame 102 by pivot bolts 142B, 143B, respectively. The pivot bolts 142B, 143B and the arms 142, 143 are relatively configured such that, when the bolts 142B, 143B are loosened, the arms 142, 143 can pivot about the bolts 142B, 143B (and the respective axes thereof), and, when the bolts 142B, 143B are tightened (by screwing), the arms 142, 143 are locked in place.

Inserts 142C and 143C are mounted in the inner ends 142D and 143D, respectively, of the arms 142, 143. The insert 143C has an internally threaded, transversely extending bore. The insert 142C has a non-threaded, transversely extending bore. An externally threaded rod 144 extends through the ends 142D, 143D and the bores of the inserts 142C, 143C. The threads of the rod 144 operatively threadedly engage the threads of the insert 143C while the bore of the insert 142C slidably receives the rod 144 to serve as a guide therefor. The rod includes a head 144A. A cylindrical bearing element 147 has a transversely extending bore within which the rod 144 is slidably received. The bearing element 147 is captured between the head 144A and the end 142D. A washer may be provided between the head 144A and the bearing element 147. The rod 144, the insert 143C and the head 144A are relatively configured such that rotation of the rod 144 in a clockwise direction will force the ends 142D, 143D together. In this manner, the sprockets 142A, 143A can be correspondingly forced away from one another to select the distance between the sprockets 142A, 143B.

In use, the bolts 142B, 143B are loosened and the rod 144 is rotated as needed to simultaneously and equally adjust the tension applied to the chains 167, 166 by the sprockets 142A, 143A. The bolts 142B, 143B are then tightened to secure the arms 142, 143 in place relative to the frame 102 and the chains 166, 167. To remove the chains 166, 167 it is only necessary to slacken the arms 142, 143 out of engagement with the chains 166, 167.

In use, actuation of the motor 127 causes all of the tie bars 120, 121, 122, 123 to be synchronously rotated in the same direction via the arrangement of the sprockets and drive chains described above. The motor 127 can be controlled to rotate the tie bars 120, 121, 122, 123 clockwise or counter-clockwise. In this way, the follower 111 can be moved towards the head 105 to close the heat exchanger 101 by rotation of the tie-bars 120, 121, 122, 123 in one direction. Also, the follower 111 can be moved away from the head 105 to open the heat exchanger 101 by rotation of the tie-bars 120, 121, 122, 123 in the opposite direction.

Figure 9:
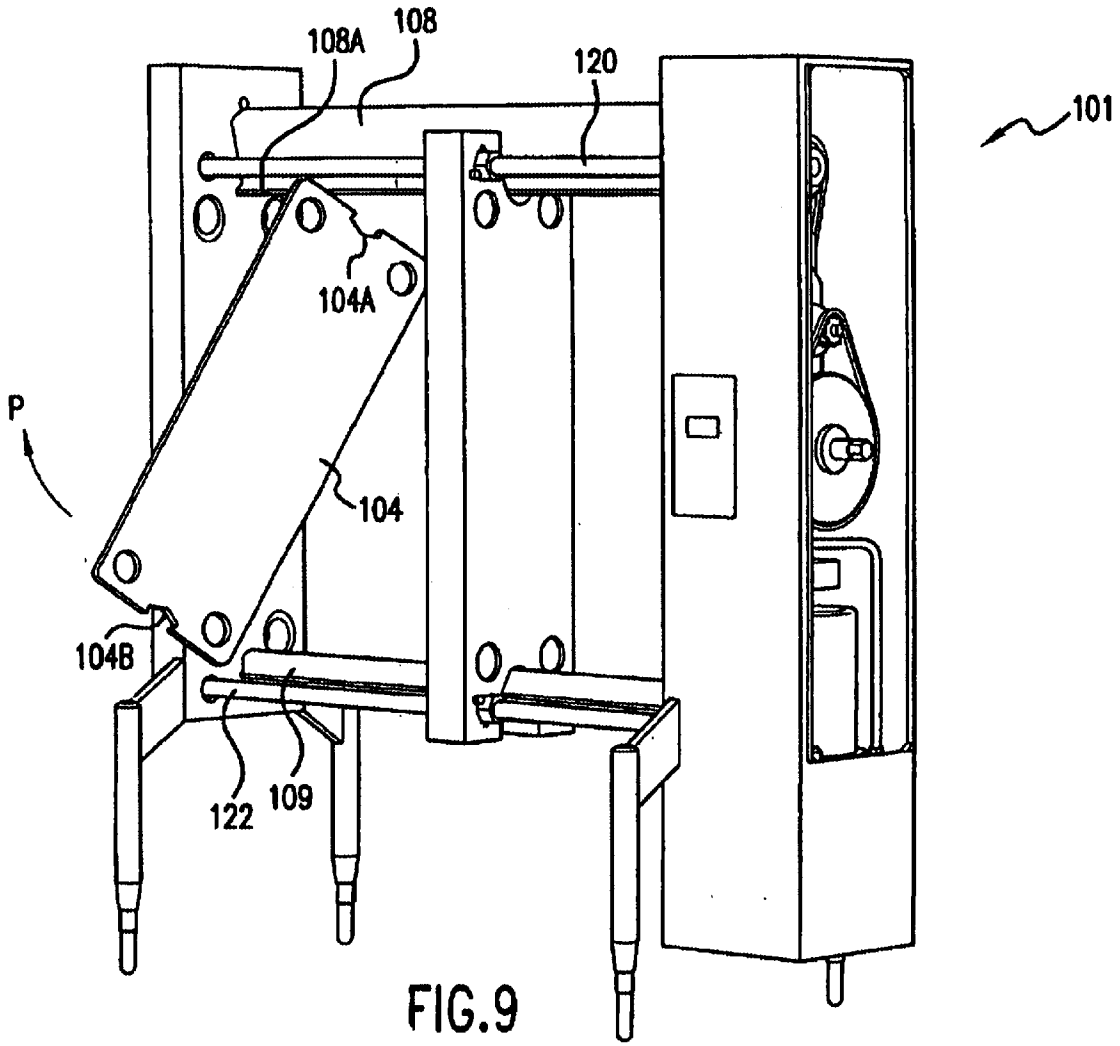
FIG. 9 is a perspective view of the heat exchanger of FIG. 4 in the open position showing the removal of a heat transfer plate of the heat exchanger.

As will be apparent from FIG. 6, the arrangement of the tie bars 120–123 above and below the plate pack 103 provides unimpeded access to the plate pack 103 from either side of the support frame 102. In this way, when the follower 111 is moved away from the head 105 to an open position as shown in FIGS. 6, 7 and 9, the plates 104 can be moved apart for inspection.

Furthermore, any or all of the plates 104 can be removed and refitted with the tie bars 120–123 in place and without dis-assembling any part of the driving mechanism. With the follower 111 in the open position, each of the plates 104 can be tilted or pivoted in a direction T about an axis transverse (e.g., substantially perpendicular) to the lengthwise axes of the beams 108, 109 as shown in FIG. 7. The tilted plate 104 can then be pivoted in a direction P generally about the lengthwise axis of the upper beam 108 as shown in FIG. 9 to disengage the slot 104A from the flanges 108A of the upper beam 108. The plate 104 can then be further pivoted in the direction P to fully remove the plate 104 from the plate heat exchanger 101. In this way, removal of one or more of the plates 104 for closer inspection, cleaning, repair or replacement is facilitated. Notably, it is not necessary to remove or relocate any of the tie bars 120–123 relative to the support frame 102 in order to remove the plates 104. Preferably, it is not necessary to remove or relocate any components of the frame 102 in order to remove the plates 104.

As will be appreciated, moving the follower 111 towards the head 105 to close the heat exchanger 101 places the tie bars 120–123 in tension between the head 105 and follower 111. In this way, the housing 107 is not required to withstand the loads applied to the plate pack 103 when the heat exchanger 101 is closed. As a result, savings in materials and costs may be achieved.

The drive mechanism 106 may be controlled via a control panel on the enclosure 107 with push buttons or other suitable means for the operator to control actuation of the motor 127 and the direction of rotation of the tie bars 120–123 to open or close the heat exchanger 101.

For a given plate pack 103 (including any additional components such as connector grids or divider plates), the spacing between the head 105 and follower 111 typically must be carefully controlled. In particular, the closing force should be sufficient to seal the plate pack 103 and prevent any leaks occurring. At the same time, over-tightening the follower 111 should be avoided to prevent possible damage to the plate pack 103 and/or deflection (bending) of the head 105 or follower 111 that could result in leaks.

Accordingly, it is necessary to measure the distance between the head 105 and follower 111 as the heat exchanger 101 is closed to ensure the correct spacing is achieved. As the head 105 and follower 111 remain parallel to each other during the opening and closing operations, this measurement can be effected at a single point. However, it still requires the operator to switch the motor 127 on and off several times to enable the measurements to be made until the desired spacing is achieved. This is time consuming and is subject to error either in the measurement or in the calculation of the desired spacing for a given plate pack 103 (including any additional components such as connector grids or divider plates).

Figure 11:
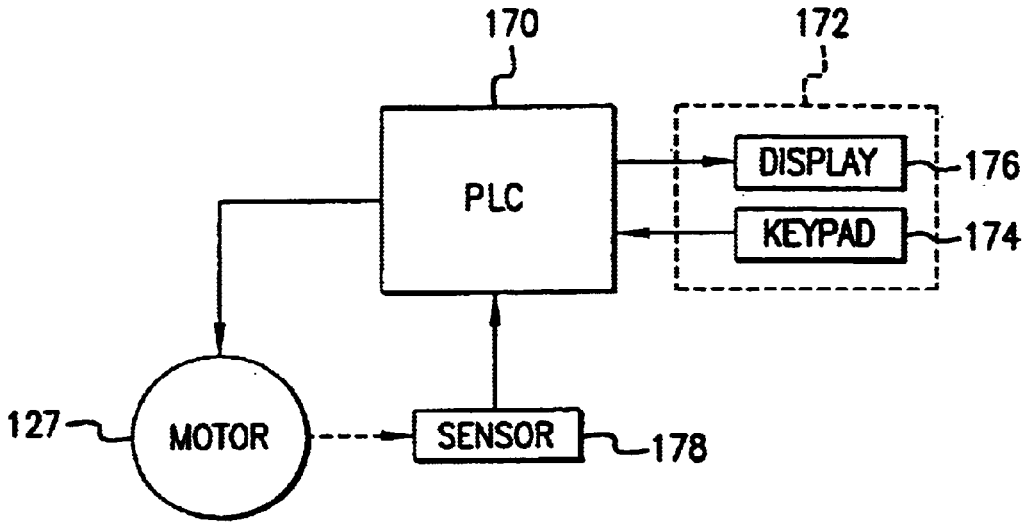
FIG. 11 is a schematic view representing a control system of the heat exchanger of FIG. 4 in accordance with embodiments of the present invention.

According to preferred embodiments of the invention, the heat exchanger 101 is provided with a control system as schematically illustrated in FIG. 11. The control system includes an electronic controller 170 to control the closing operation to achieve the desired spacing of the head 105 and follower 111 for a given plate pack 103 (including any additional components such as connector grids or divider plates). The controller 170 incorporates suitable hardware/software and a control panel interface 172 for the operator. The controller 170 may include, for example, a programmable logic controller (PLC), a microcontroller or an analog controller. Preferably, the controller 170 includes a PLC. The control panel 172 may include any suitable human machine interface, such as a keypad 174 and a display 176.

The controller 170 may be programmed with the number of plates and individual initial plate pitch so that the operator only has to initiate the closing operation by actuating a push button or similar input device on the control panel 172. The controller 170 will then operate the driving mechanism 106 until the exact dimension is achieved and then shut off. Likewise, the operator may initiate an opening operation by pressing a button or the like, whereupon the controller 170 will operate the driving mechanism 106 to open the heat exchanger to a predefined position for plate inspection and removal.

The controller 170 may be programmed in the factory during manufacture of the heat exchanger 101 for a given package of heat transfer plates (including any additional components such as connector grids or divider plates). The control panel 172 may be provided with separate controls such as push buttons to initiate opening and closing of the heat exchanger 101.

On initiating the opening operation, the follower 111 will move to the open position for plate inspection or removal. If the drive motor 127 is a hydraulic motor and the controller 170 includes a PLC, accurate follower positioning may be achieved by the PLC which determines the direction of flow and reads a sensor located on the hydraulic motor 127 which rotates the ties bars 120–123 at a known fixed ratio.

The control panel 172 may include means (such as the keypad 174) to program the PLC with new data if the number of plates 104 and/or any additional components such as connector grids or divider plates is changed. In this way, the set-up of the heat exchanger 101 can be easily adapted to control the opening and closing operations for different spacings of the head 105 and the follower 111.

Furthermore, over the operating life of the heat exchanger 101, compression set of the sealing gaskets between adjacent plates 104 of the plate pack 103 will reduce the required spacing between the head 105 and follower 111 to achieve optimum sealing efficiency. The manufacturer, factory or operator can program the controller 170 (e.g., a PLC) via the control panel 172 to take account of such changes.

One or more sensors 178 (FIG. 11) may be provided to provide feedback to the controller 170. The sensor(s) 178 may sense a condition of the motor 127 (e.g., hydraulic flow rate or RPM) or a condition of the plates 104 or the follower 111. The sensor or sensors 178 may be, for example, displacement sensors, absolute encoders, incremental encoders or proximity switches.

To ensure the safe operation of the heat exchanger, the heat exchanger may include one or more fail-safe devices to eliminate or reduce the risk of damage to the heat exchanger from malfunction or deliberate or inadvertent illegal or improper operation of the closure system during powered opening and/or closing movement of the follower 111. For example, a fail safe proximity sensor or sensors can be installed such that the follower 111 cannot be automatically opened into the enclosure 107. A pressure relief valve (not shown) can be included in the hydraulic circuit for the motor 127 should the follower 111 be forced to close beyond set parameters. Alternatively or additionally, the controller 170 can be programmed to prevent overextension. For example, the controller 170 can be adapted (e.g., programmed) to count the rate of pulses and stop the motor when the hydraulic motor RPM or flow rate falls below a prescribed limit, (i.e., a "stalled" condition).

During the closing or opening process, significantly varying loads are experienced by the closing mechanism which approach zero at fully open, through a moderate increase as the gaskets come into contact, to the maximum as all the metal plates 104 touch. According to some embodiments, the drive mechanism 106 is a variable speed drive mechanism. For example, a variable speed hydraulic circuit may be provided for the motor 127 which ramps (i.e., continuously), steps, or switches from a high volume, low pressure operation at the beginning of the closing cycle to low volume, high pressure operation when nearly closed. In this way, varying loads experienced by the driving mechanism from almost zero load when fully open through a large increase in load as the sealing gaskets come into contact up to the maximum load as all the metal plates touch can be accommodated. This arrangement permits rapid initial closing and slow final closing whereby the total closing or opening time may be reduced without increasing the size/capacity and therefore cost of the entire drive mechanism 106.

A hexagon drive shaft 132 (see FIG. 6) is provided for single point manual opening or closing of the heat exchanger if desired, for example, in the event of a power failure. The drive shaft is provided at a position in the transmission that takes advantage of the sprocket or gear ratios to reduce the required input force and is accessible through the doorway in the enclosure.

When power is restored following a power failure or when the power is switched on, the controller 170 may be adapted (e.g., programmed) to perform or offer to perform a homing cycle to reset the follower position the next time the heat exchanger 101 is opened or closed, in case the follower 111 was moved manually while power was absent. All input parameters are preferably stored in non-volatile memory.

It will be understood that various modifications and changes can be made to the above-described embodiment. For example, the number of tie bars employed to open and close the heat exchanger may be altered from that shown, preferably with a minimum requirement of two tie bars, one above and one below the plate pack. Any suitable drive mechanism for the tie bars may be employed.

As discussed above, a separate drive chain is provided to drive each tie rod. However, various of the features and aspects of the present invention as described above may be incorporated into heat exchangers of other designs and configurations. For example, the heat exchanger may be adapted to have two drive chains, one arranged to drive the two upper tie rods 120, 121 and the other arranged to drive the two lower tie rods 122, 123. Additionally, while drive chains are described above, other types of endless drive members, such as drive belts may be employed.

The tensioners 140, 141 provide a number of advantages. Only two tensioning mechanisms are needed to maintain four drive chains. The tensioners 140, 141 are self-balancing on adjustment (i.e., if one chain of the pair of drive chains stretches more than the other, the tensioner is self-correcting to provide the same tension to both drive chains). The tensioners 140, 141 allow for easy access and convenient adjustment of the chain tensions. The tensioners allow for convenient removal and installation of the drive chains.

While electronic controllers for automatically controlling the motor 127 are described above, a controller such as a manually operable switch may be used to non-automatically or semi-automatically control the motor 127 instead. Moreover, the drive mechanism 106 may be manually operable (e.g., by hand or using a tool) rather than motor driven.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A plate heat exchanger comprising:

a) first and second plates;

b) a package of heat transfer plates arranged between the first and second plates; and c) a closure system including a plurality of tie bar assemblies, each tie bar assembly including:

a tie bar extending between the first and second plates; and a threaded member threadedly engaging the tie bar;

wherein the closure system and the first and second plates are relatively arranged and configured such that relative rotation between the tie bar and the threaded member of each tie bar assembly is operative to move the first plate towards and away from the second plate to close and open, respectively, the plate heat exchanger;

d) wherein the plate heat exchanger is arranged and configured such that the heat transfer plates can be removed from the plate heat exchanger without relocating any of the tie bars; and e) wherein each of the threaded members is secured to one of the first and second plates.

2. The plate heat exchanger of claim 1 wherein:

a) each of the heat transfer plates defines an outer periphery; and b) all of the tie bars are positioned outside of the outer peripheries of the heat transfer plates.

3. The plate heat exchanger of claim 2 wherein:

a) each of the heat transfer plates has a pair of opposed first edges and a pair of opposed second edges that are adjacent and longer than the first edges; and b) all of the tie bars are positioned adjacent at least one of the first edges of the heat transfer plates.

4. The plate heat exchanger of claim 1 including a support frame, wherein the heat transfer plates and the first and second plates are mounted on the support frame.

5. The plate heat exchanger of claim 1 wherein the first plate is movable relative to the frame and the second plate is fixed relative to the frame.

6. The plate heat exchanger of claim 1 wherein each threaded member is captured to prevent relative rotation between the threaded member and one of the first and second plates.

7. The plate heat exchanger of claim 6 wherein at least some of the tie bar assemblies are independently rotatable to move the first plate towards and away from the second plate.

8. The plate heat exchanger of claim 6 wherein each of the tie bar assemblies is independently rotatable to move the first plate towards and away from the second plate.

9. The plate heat exchanger of claim 1 further including a drive mechanism, wherein at least two of the tie bar assemblies are synchronously and simultaneously rotatable using the drive mechanism to open and close the plate heat exchanger.

10. The plate heat exchanger of claim 9 wherein the drive mechanism includes at least one flexible, endless drive member for synchronously rotating a plurality of the tie bars and/or the threaded members.

11. The plate heat exchanger of claim 9 wherein the drive mechanism includes a plurality of flexible, endless drive members, each of the drive members being connected to a respective one of the tie bars and/or the threaded members such that each of the drive members rotates only one of the tie bars and threaded members.

12. The plate heat exchanger of claim 9 wherein the drive mechanism is manually operable.

13. The plate heat exchanger of claim 9 wherein the drive mechanism is powered by at least one motor.

14. The plate heat exchanger of claim 13 wherein the motor is reversible to move the first plate towards and away from the second plate to close and open, respectively, the heat exchanger.

15. The plate heat exchanger of claim 13 wherein the drive mechanism includes a controller to control powered movement of the first plate to open and close the heat exchanger.

16. The plate heat exchanger of claim 15 wherein the controller is operable to stop the first plate at at least one predefined position.

17. The plate heat exchanger of claim 13 wherein the drive mechanism includes an electronic controller to automatically control powered movement of the first plate to open and close the heat exchanger.

18. The plate heat exchanger of claim 17 wherein the electronic controller incorporates programmable logic control (PLC) hardware/software and a control panel interface.

19. The plate heat exchanger of claim 18 wherein the electronic controller is operable to stop the first plate at at least one predefined position and the control panel includes an input device for programming the electronic controller to set the predefined position.

20. The plate heat exchanger of claim 17 wherein the electronic controller is operative to perform a homing cycle.

21. The plate heat exchanger of claim 13 wherein the closure system includes at least one fail-safe device and/or logic for limiting movement of the first plate.

22. The plate heat exchanger of claim 13 wherein the drive mechanism is a variable speed drive mechanism.

23. The plate heat exchanger of claim 13 wherein the closure system includes a mechanism for manually opening and closing the heat exchanger when the motor is inoperable.

24. The plate heat exchanger of claim 4 wherein the support frame includes an end member opposite the second plate and, in addition to the tie bars, at least one frame cross member extending from the second plate to the end member and being rigidly affixed to each of the second plate and the end member.

25. The plate heat exchanger of claim 4 wherein, when the plate heat exchanger is closed, the tie bars are loaded in tension to apply a compressive load to the heat transfer plates between the first and second plates and such that the compressive load is not applied to the end member.

26. A plate heat exchanger comprising:

a) first and second plates;

b) a package of heat transfer plates arranged between the first and second plates;

c) a closure system including a plurality of tie bar assemblies, each tie bar assembly including:

a tie bar extending between the first and second plates; and a threaded member threadedly engaging the tie bar;

wherein the closure system and the first and second plates are relatively arranged and configured such that relative rotation between the tie bar and the threaded member of each tie bar assembly is operative to move the first plate towards and away from the second plate to close and open, respectively, the plate heat exchanger;

d) wherein the plate heat exchanger is arranged and configured such that the heat transfer plates can be removed from the plate heat exchanger without relocating any of the tie bars;

e) a plurality of flexible, endless drive members, each of the drive members being connected to a respective one of the tie bars or threaded members; and f) a tensioning system to control tensions in each of the drive members, the tensioning system including a pair of arms each having an engagement end engaging a respective one of the drive members, the arms being pivotally mounted on the plate heat exchanger such that a distance between the engagement ends is variable by pivoting the arms.

27. The plate heat exchanger of claim 26 wherein the drive members are connected to the tie bars and/or threaded members such that each of the drive members rotates only one of the tie bars or threaded members.

28. The plate heat exchanger of claim 26 further including an adjustment mechanism for selecting the distance between the engagement ends of the drive members to thereby control the tensions in the drive members.

29. The plate heat exchanger of claim 26 wherein the tensioning system is self-balancing such that the tensions in the drive members are substantially the same within at least a prescribed range of tensions.

30. The plate heat exchanger of claim 26 wherein each of the engagement ends includes a rotatable roller engaging the respective one of the drive members.

31. The plate heat exchanger of claim 26 wherein the arms are pivotally mounted on the plate heat exchanger to pivot about different pivot axes.

32. A method for cleaning, repairing and/or modifying a plate heat exchanger, said method comprising:

a) providing a plate heat exchanger comprising:

1) first and second plates;

2) a package of heat transfer plates arranged between the first and second plates; and 3) a closure system including a plurality of tie bar assemblies, each tie bar assembly including:

a tie bar extending between the first and second plates; and a threaded member threadedly engaging the tie bar;

wherein the closure system and the first and second plates are relatively arranged and configured such that relative rotation between the tie bar and the threaded member of each tie bar assembly is operative to move the first plate towards and away from the second plate to close and open, respectively, the plate heat exchanger; and wherein each of the threaded members is secured to one of the first and second plates.

b) moving the first plate towards the second plate by rotating the tie bar assemblies to close the plate heat exchanger; and c) moving the first plate away from the second plate by rotating the tie bar assemblies to open the plate heat exchanger; and thereafter d) removing at least one of the heat transfer plates from the opened plate heat exchanger without removing any of the tie bars from the plate heat exchanger.

33. The method of claim 32 including using a motor and an electronic controller to move the first plate relative to the second plate, wherein the electronic controller incorporates programmable logic control (PLC) hardware/software.

34. The method of claim 33 including using the motor and the electronic controller to move the first plate to a predefined position relative to the second plate and programming the electronic controller to set the predefined position.

35. A plate heat exchanger comprising:

a) first and second plates;

b) a package of heat transfer plates arranged between the first and second plates; and c) a closure system including:

at least two tie bars extending between the first and second plates and adapted to maintain a compressive load applied to the package of heat transfer plates by the first and second plates;

a motor operable to control the compressive load; and an electronic controller to automatically control the motor;

d) wherein the plate heat exchanger is arranged and configured such that the heat transfer plates can be removed from the plate heat exchanger without relocating any of the tie bars.

36. The plate heat exchanger of claim 35 wherein the electronic controller includes a programmable logic controller (PLC) and a control panel interface.

37. The method of claim 32 wherein moving the first plate towards the second plate by rotating the tie bar assemblies to close the plate heat exchanger includes rotating the tie bars.

38. The plate heat exchanger of claim 36 wherein the control panel includes an input device for programming the electronic controller to set the predefined position.

39. The plate heat exchanger of claim 35 wherein the electronic controller is operative to perform a homing cycle.

40. The plate heat exchanger of claim 35 wherein the closure system includes at least one fail-safe device and/or logic for limiting movement of the first plate.

41. The plate heat exchanger of claim 35 wherein the motor is a variable speed drive motor.

42. A plate heat exchanger comprising:

a) first and second plates;

b) a package of heat transfer plates arranged between the first and second plates; and c) a closure system including:

1) a plurality of tie bar assemblies, each tie bar assembly including:
   a tie bar extending between the first and second plates; and
   a threaded member threadedly engaging the tie bar;
   wherein the closure system and the first and second plates are relatively arranged and configured such that relative rotation between the tie bar and the threaded member of each tie bar assembly is operative to move the first plate towards and/or away from the second plate to close and/or open, respectively, the plate heat exchanger;
2) a plurality of flexible, endless drive members, each of the drive members being connected to a respective one of the tie bars and/or threaded members such that each of the drive members rotates only one of the tie bars and threaded members; and
3) a motor operative to synchronously drive the drive members to rotate the tie bars and/or threaded members.

43. The plate heat exchanger of claim 42 wherein the motor is operative to drive the drive members to rotate the tie bars and/or threaded members in either of two opposed directions to open and close the plate heat exchanger.

44. The plate heat exchanger of claim 42 further comprising a tensioning system to control tensions in each of the drive members, the tensioning system including a pair of arms each having an engagement end engaging a respective one of the drive members, the arms being pivotally mounted on the plate heat exchanger such that a distance between the engagement ends is variable by pivoting the arms.

45. The plate heat exchanger of claim 44 further including an adjustment mechanism for selecting the distance between the engagement ends of the drive members to thereby control the tensions in the drive members.

46. The plate heat exchanger of claim 44 wherein the tensioning system is self-balancing such that the tensions in the drive members are substantially the same within at least a prescribed range of tensions.

47. The plate heat exchanger of claim 44 wherein each of the engagement ends includes a rotatable roller engaging the respective one of the drive members.

48. The plate heat exchanger of claim 44 wherein the arms are pivotally mounted on the plate heat exchanger to pivot about different pivot axes.

49. A plate heat exchanger comprising:

a) a frame;

b) first and second plates mounted on the frame;

c) a package of heat transfer plates arranged between the first and second plates; and d) a closure system including a plurality of tie bars extending between the first and second plates and arranged for movement of the first plate towards and/or away from the second plate;

e) wherein the plate heat exchanger is arranged and configured such that the heat transfer plates can be removed from the plate heat exchanger without relocating any of the tie bars and without relocating, partially or fully, any components of the frame.

50. A plate heat exchanger comprising:

a) first and second plates;

b) a package of heat transfer plates arranged between the first and second plates; and c) a closure system including a plurality of tie bar assemblies, each tie bar assembly including:
   a tie bar extending between the first and second plates; and
   a threaded member threadedly engaging the tie bar;
   wherein the closure system and the first and second plates are relatively arranged and configured such that relative rotation between the tie bar and the threaded member of each tie bar assembly is operative to move the first plate towards and away from the second plate to close and open, respectively, the plate heat exchanger;

d) wherein the plate heat exchanger is arranged and configured such that the heat transfer plates can be removed from the plate heat exchanger without relocating any of the tie bars; and e) wherein the tie bars are positioned outside and spaced apart from outermost edges of the heat transfer plates.

* * * * *